United States Patent [19]

Bianchi

[11] 4,171,795

[45] Oct. 23, 1979

[54] SAFETY LINE AND MECHANISM

[76] Inventor: Buddy Bianchi, 4211 W. 57th St., Cleveland, Ohio 44144

[21] Appl. No.: 830,099

[22] Filed: Sep. 2, 1977

[51] Int. Cl.[2] ..... A62B 1/08

[52] U.S. Cl. ..... 254/151; 182/5; 188/188

[58] Field of Search ..... 254/151, 153, 156, 157; 182/5; 188/188

[56] References Cited

U.S. PATENT DOCUMENTS

| | | | |
|---|---|---|---|
| 311,039 | 1/1885 | Scheidt et al. | 182/5 |
| 1,308,480 | 7/1919 | Caouette | 254/157 |
| 2,729,425 | 1/1956 | Gschwind | 254/157 |
| 2,761,650 | 9/1956 | Fangier | 254/153 |
| 3,333,822 | 8/1967 | Horvath | 254/156 |
| 3,389,765 | 6/1968 | Pressley, Sr. | 182/5 |
| 3,968,865 | 7/1976 | McElroy | 188/188 |
| 3,980,161 | 9/1976 | Mauldin | 188/188 |

FOREIGN PATENT DOCUMENTS

| | | | |
|---|---|---|---|
| 2439678 | 3/1976 | Fed. Rep. of Germany | 254/156 |

*Primary Examiner*—Kenneth W. Noland
*Attorney, Agent, or Firm*—Robert Bruce Henn

[57] ABSTRACT

A safety line for use in industrial and other construction is combined with a take-up reel and braking device. The mechanism is maintained in a housing attached to harness device worn by the worker, with the line being attached to a suitable structural component. When the line is paid out slowly, the take-up mechanism serves to keep the slack line from interfering with normal operations; if the line is paid out rapidly, as when the worker falls, the braking device serves to snub the line before the worker can fall far enough to incur injury. A locking device prevents line movement, if desired.

2 Claims, 3 Drawing Figures

SAFETY LINE AND MECHANISM

BACKGROUND OF THE INVENTION

1. Field of the Invention

This invention is in the field of safety devices; more particularly, this invention is directed to the field of devices to prevent injury to workers in situations where there is a danger of falling.

2. Description of the Prior Art

Wherever workers perform duties in unenclosed surroundings substantially above a base level, there is a danger of the worker falling from the work station and being injured or killed. Situations of this nature could occur, for instance, in the construction of tall buildings, within existing structures, inside subterranean operations such as salt or coal mines, or on residential structures. There are even standard statistical figures for the expected number of deaths, most frequently due to falls from the structure, for building and bridge construction.

Despite statistics, any loss of human life is clearly unacceptable where it can be prevented. In the past, the methods used for worker safety have up to now been either expensive, cumbersome or only marginally effective, and sometimes all of these simultaneously. Some examples are the use of wooden snow fence on the sides of unclosed high-rise construction; safety nets at or below the sides of open work areas; static safety lines attached to the worker and to the work structure; and various other forms of physical barricades.

While a wooden fence is effective, it is not completely fail-safe, and there is the possibility that a worker could either fall over the top thereof or break through the fence at a point of attachment. Further, there are times and places where a fence cannot be used due to construction peculiarities, such as when the side or edge of a building floor is itself the subject of the construction effort. In such a case, a safety net, maintained below the work area, is the usual alternative.

The safety net is of significant value in worker safety, and has proven its effectiveness both in keeping the worker safe in the event of a fall, and in not subjecting him to associated problems involved in the operation of the net itself; in other words, the worker falling into a net is not likely to suffer injury caused by the net, where he might still have a few bruises from a wooden fence, or internal injuries from a safety line. The cost of safety nets however, is substantial; the labor involved is a significant and non-productive, though necessary, cost in the construction process. Further, the process of rigging the net itself is hazardous to a degree.

The static safety line, in terms of cost and time, is the most effective of the safety devices used in keeping workers from injury in high-rise construction, but there are some drawbacks to its use, although none of them is serious. The most common problem is that of fouling the line; the worker must maintain constant alertness to prevent both himself and others from tripping over the line, or getting it caught in material or equipment on the job. A second problem is that when the line serves its preventive function by stopping a worker from falling, it is only after the worker has already fallen as far as the line extends; at that point, the line snaps taut, and the worker is stopped with a severe shock, one which is sufficient to cause some internal injury.

Devices are known for controlling or diminishing the rate of passage of a rope or other line. For instance, Vescovi shows devices in U.S. Pat. Nos. 1,352,230 and 1,444,015 which are useful as fire escapes. Riches, U.S. Pat. No. 737,145 and Meaders, U.S. Pat. No. 797,903, also show fire-escape devices. In all of these mechanisms, however, there is no provision for a rate-responsive action within the device; they all require the agency of the operator to control the rate of passage of the line.

While Vescovi U.S. Pat. No. 1,352,230 and Riches and Meaders all show what may be considered to be braking means, they all require human agency to set that braking means at a rate appropriate for the circumstances. There is no provision in any of these devices to permit the line to run free at a low rate while preventing its running out rapidly, unless the operator affirmatively makes that adjustment for each circumstance encountered.

Watts shows a safety brake in U.S. Pat. No. 3,830,346, useful for scaffolding. The Watts device has utility only when operating in a substantially vertical mode; and when the device is triggered by high-rate passage of the line through it, the mechanism must be disassembled before it can be made to function again.

SUMMARY OF THE INVENTION

The present invention is a safety line in combination with a mechanism which keeps the line neatly tight under normal operation, but which serves to stop the line from paying out almost instantly if the worker should fall from the work station; there is included a manual brake which permits the worker to lock the line at a given extension, where the circumstances demand it. The mechanism is maintained within a housing to protect the functioning parts from contamination.

It is therefore an object of this invention to provide new and improved means to secure worker safety in elevated construction work; it is a further object to provide a safety line and reel; it is yet another object of this invention to provide a safety line and reel which will maintain a line without slack and permit its ready payout, but which will lock immediately on demand; it is a still further object of this invention to provide a safety line which can be locked at will. It is another object to provide a safety device which does not require the operator's attention. It is an object of this invention to provide one or more of the foregoing objects; these and other objects will become obvious to those skilled in the art from a consideration of the drawings, specification and claims set forth herein.

DESCRIPTION OF THE PREFERRED EMBODIMENTS

Figure 1:
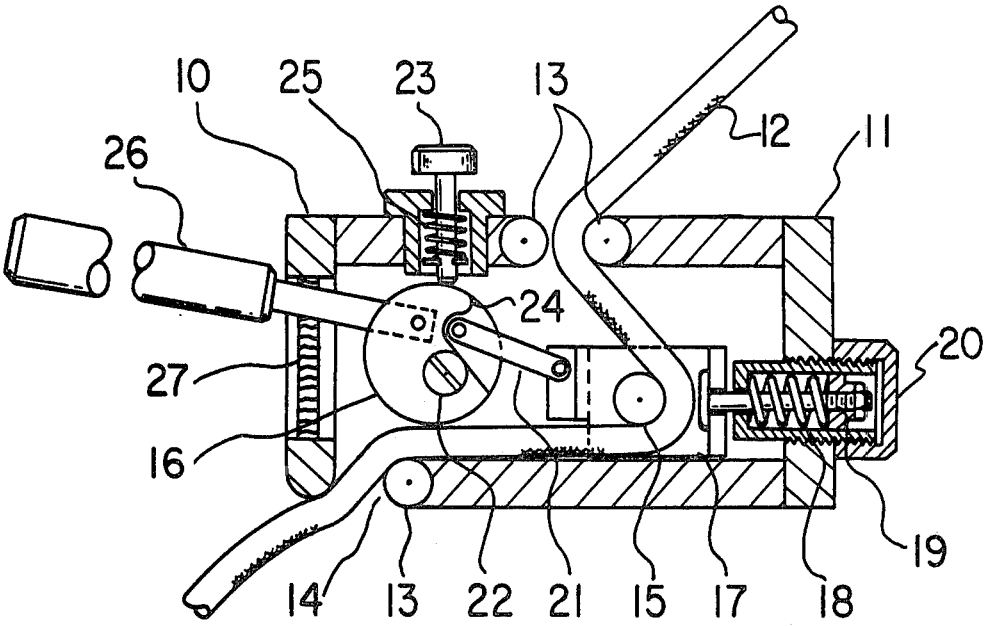
FIG. 1 is a sectional view of one embodiment of the apparatus of the present invention, showing manual and response locking means.

The present invention is an apparatus for preventing injury to workers exposed to falling from positions required by their work function, comprising a safety line, retraction means for said line, locking means for said line, housing means, and attachment means.

In the most preferred embodiment of the apparatus of the present invention, there is provided a mechanism in a housing to prevent contamination of the working parts, and a harness for attaching the mechanism to the body of the worker. Generally, the harness will permit the attachment of the apparatus on the worker's back, preferably at or just above his waistline, most preferably at the worker's center of mass. In this fashion, the safety line can pay out and retract without interfering with the worker's attention to his job function such as, e.g., welding. It will be apparent to those skilled in the art that the harness should be arranged to provide maximum comfort to the worker, combined with reasonable ease of putting it on and removing it, in order to minimize psychological barriers to the use of the safety device.

The housing means can be arranged to provide for the most convenient attitude of the safety line, so that, for instance, if the worker is engaged in operations where a portion of the structure is above him, the line can be affixed overhead, and pay out in a vertical fashion; if the worker is at the top of the construction, the line would necessarily be affixed to the same level as the worker and could then be arranged to pay out to the left or right as appropriated, or directly behind if desired.

The safety line itself must necessarily be of sufficient strength to hold the weight of the worker in the event of a fall, and further to withstand the shock of sudden deceleration as the response locking means is actuated, along with an adequate design safety factor to account for the weight of the worker and his tools and equipment, and the deceleration of the entire mass. At the same time, the safety line must be light enough that its weight will not contribute significantly to worker fatigue, and must be adequately resistant to abrasion. Preferred compositions for the safety line are nylon, polypropylene and vinyl-clad steel.

The shape of the line is unimportant to the operation of the present invention, and can be either in conventional rope form or a flat strap, in the manner of an automobile seat belt. The free end of the line is conveniently secured to a pelican hook, snap ring, or other means for fastening to the structure.

The mechanism of the retraction reel and locking means, carried within the housing attached to the worker, must be kept free from anything which might interfere with the safety function; thus, metal chips, dust, grease and other contaminants must be excluded from the interior.

In order to keep the safety line free of slack, retraction means is disposed within the housing, generally comprising spring means affixed to a reel or track upon which the line is carried. The spring could conveniently be in the nature of a mainspring for a clock mechanism, the size and length thereof being chosen as dictated by the particular job characteristics for worker mobility from the point of attachment of the fastening means; a ten-foot reach would be about the least for economical utilization, while 25 feet would represent the most line which could reasonably be disposed within the housing, although neither figure is intended as limiting.

The response locking means of the present invention comprises guide means to cause the safety line to pay out through a prescribed path, within pre-set load or velocity limits, means to permit or cause the line to depart from said prescribed path under abnormal load or velocity conditions, and locking means to arrest the movement of the line when it departs from the prescribed path. In one embodiment, the guide means comprises a spring-loaded eye-bolt through which the safety line passes; the line is held just out of contact with a cam. When the rate of movement of the line increases to a point representing a worker's fall, the pull on the eye-bolt permits the spring to extend slightly, bringing the line into contact with the cams; the cam then revolves sufficiently about its axis to cause the line to jam between the cam and a complementary braking surface. As long as the load is maintained on the line, the cam is locked in position, and cannot be released.

In one embodiment of the present invention, manually operated locking means can be provided for situations where an affirmative braking action is useful, such as where a worker might have to lean over the edge of a portion of the construction, and have the line at least partially support him, rather than pay out. Such locking means can be integral with the response locking means, or can be separate therefrom.

FIG. 1 shows the response locking mechanism and manual means of one embodiment of the present invention, where the apparatus is shown generally at 10. A housing 11 is preferably formed of a material having sufficient strength to carry the load of the weight of a human being, and additionally to withstand the shock of such load on sudden deceleration. Safety line 12 passes through the mechanism of the apparatus through stationary rollers 13 and reel access opening 14. The line 12 passes over a guide means 15, disposed to maintain line 12 in spaced relationship with locking cam 16. While guide means 15 is preferably a rotary device such as a ball- or needle-bearing assembly, it can also be a stationary means chosen for low friction with line 12, such as hardened corrosion-resistant metal, or suitable polymeric material such as polytetrafluoroethylene.

Guide means carrier 17 is disposed to move slidably in a linear relationship with locking cam 16, and is maintained in that relationship by tensioning means 18, adjustably affixed thereto by adjustment means 19, shown here as a threaded shaft with a locking nut. Access means 20 provides protection from contamination and tampering for tensioning means 18 and adjustment means 19, as well as access thereto for adjustment of the sensitivity or pre-load characteristics of the mechanism. Linkage means 21 provides a mechanical coupling between carrier 17 and cam 16 in such fashion that when line 12 passes over guide means 15 at a predetermined high rate, cam 16 is caused to rotate about off-center pivot point 22, whereby line 12 is jammed against one portion of housing 11, adjacent to reel access opening 14.

While those skilled in the art will recognize that the jamming of the line will cause the line to stop and to remain stationary as long as the load remains thereon, the apparatus of the present invention provides further for locking pin 23 to move into detent 24 in cam 16 on actuation of the mechanism, thus provided a further measure of safety irrespective of the load. Pin 23 is biased by spring 25 to urge the pin into locking detent 24 on cam 16.

In one embodiment of the apparatus of the present invention, there is provided a manual means for locking the line; thus, if the worker perceives the danger of a fall before the event actually occurs, he would be able to move handle 26 to cause movement of cam 16, and thereby lock line 12 in position immediately. Alternatively, if the worker is engaged in a task which requires support in a situation where he is unable to rely upon the structure, he can activate the manual locking means before starting the task, and utilize the support of the safety line in his job function. An unexpected result of this feature is that the worker has a more relaxed attitude in such a situation, knowing that he is in no danger of falling; he is therefore less prone to make mistakes, and is more productive.

In order to keep dirt out of the mechanism, boot 27 or equivalent flexible sealing means is provided for the shaft of handle 26. In an embodiment where the manual locking means is not used, neither the handle nor the boot would be provided, and housing 11 would be solid in the region.

Figure 2:
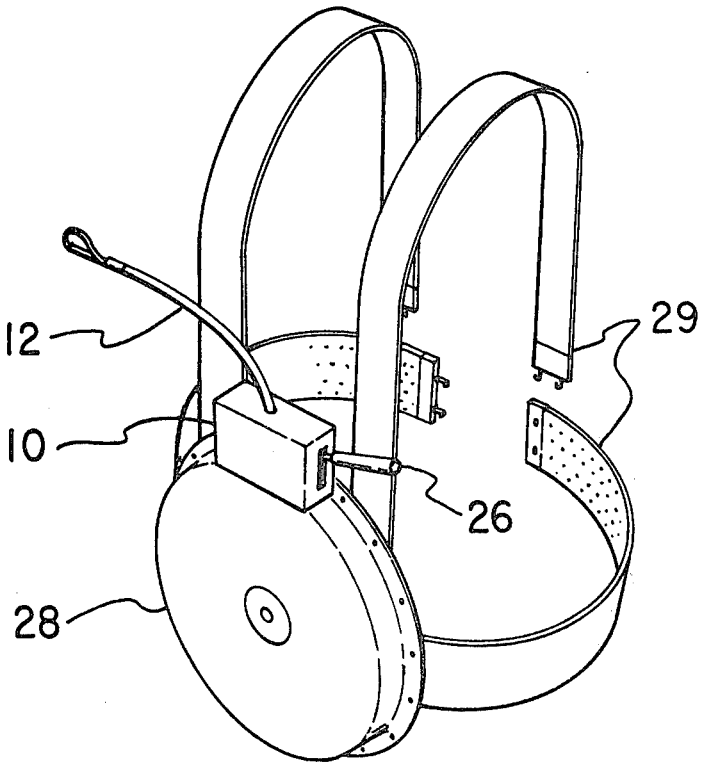
FIG. 2 is a view in perspective of the apparatus of the present invention in a housing, showing harness means for attachment to the body of the worker.

FIG. 2 shows the apparatus of the present invention in its housing, affixed to attachment means for use by the worker. The apparatus 10 is shown as integral with line-storage and retraction means 28; harness 29 is adapted to be worn by the worker in such fashion that the exit point of line 12 is substantially at the worker's center of mass, thereby to minimize strain and shock to the worker's body in the event of a fall and the sudden actuation of the mechanism.

Figure 3:
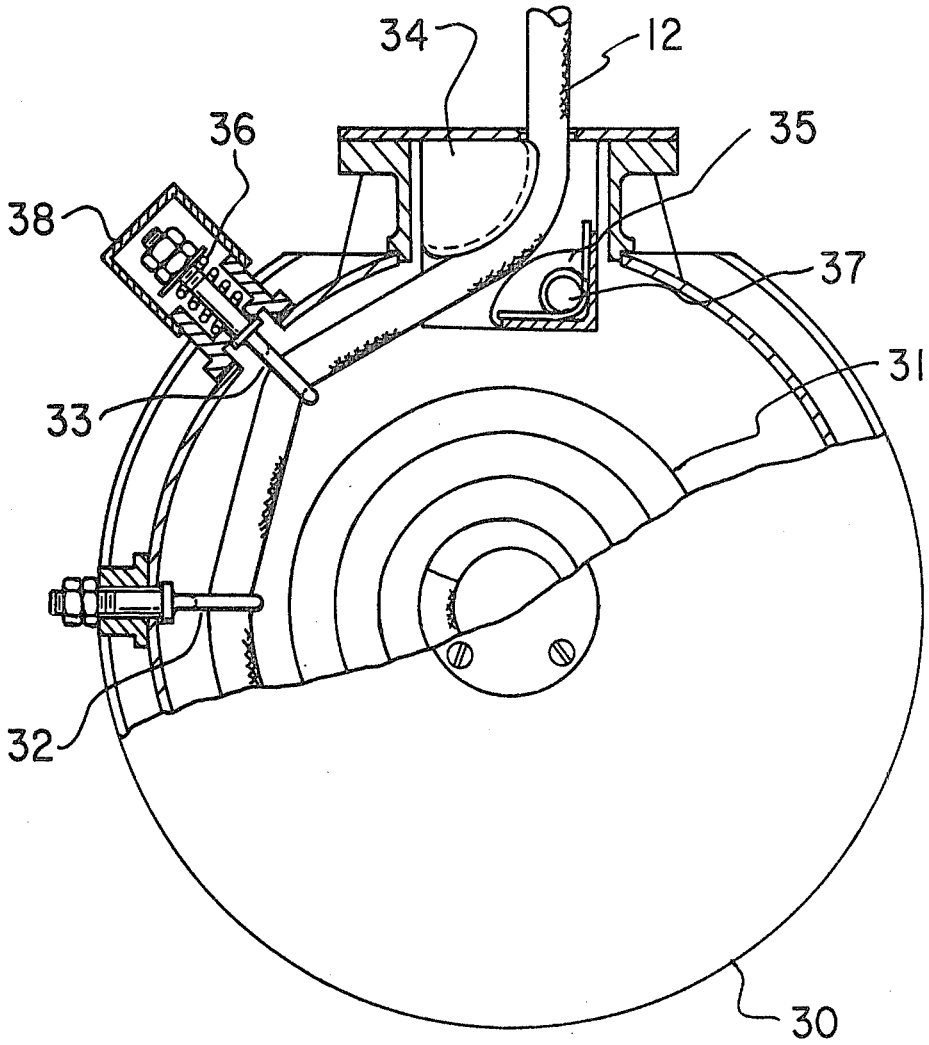
FIG. 3 is a view of the apparatus of the present invention, with the housing partially cut away to show another embodiment of the response locking means.

FIG. 3 shows an alternative embodiment of the apparatus of the present invention, where line 12, shown here as a rope of conventional circular cross-section, is disposed upon reel 31, carried in housing 30; in paying out or retracting, line 12 passes through guide 32 and through guide and tensioning means 33 and then over braking block 34, in spaced relationship with braking cam 35. In operation, the low-rate passage of line 12 through guide and tensioning means 33 permits the line to move slidably over braking block 34; if the line should start moving rapidly, however, such as where a worker falls, spring 36 of guide and tensioning means 33 permits the line to move slightly toward braking cam 35; cam 35, having a knurled face, is caused to pivot about axis 37, forcing the line into braking block 34, and causing the mechanism to jam until the load is removed from the line. Access means 38 provides environmental and mechanical protection for the mechanism of guide means 33.

Guide 32, tensioning means 33 and braking block 34 are preferably formed from material having a low coefficient of friction with line 12, such as, e.g., hardened corrosion-resistant metal.

The retraction means for causing line 12 to be pulled back into housing 30 could comprise, e.g., a coil spring affixed to the interior end of the line, or could comprise other spring means affixed to a gear mechanism for rewinding the line; such means is not shown, being well known to those skilled in the art, and the exact retraction means being immaterial to the operation of the present invention.

Modifications, changes and improvements to the preferred forms of the present invention herein disclosed, described and illustrated may occur to those skilled in the art who come to understand the principles and precepts thereof. Accordingly, the scope of the patent issued hereon should not be limited to the particular embodiments of the invention set forth herein, but rather should be limited by the advance by which the invention has promoted the art.

What is claimed is:

1. An apparatus for improved worker safety comprising in combination a reel having internal retractive means cooperatively affixed thereto; a safety line affixed to said reel, said safety line passing through guide means maintained in spaced relationship with a locking cam to jam said safety line upon the predetermined high-rate movement of said safety line, said locking cam being provided with a detent, said apparatus being further provided with a locking pin, said locking pin being disposed to move into said detent and arrest said locking cam in an engagement position upon the operation of said locking cam, said tensioning means further functioning to cause said locking cam to release said safety line upon removal of load from said safety line.

2. The apparatus of claim 1 wherein manual locking means is provided, said manual locking means being adapted to function independently of said tensioning means.

* * * * *